US010460644B2

(12) United States Patent
Guo et al.

(10) Patent No.: US 10,460,644 B2
(45) Date of Patent: Oct. 29, 2019

(54) DRIVING SYSTEMS OF DISPLAY PANELS

(71) Applicant: Wuhan China Star Optoelectronics Technology Co., Ltd., Wuhan, Hubei (CN)

(72) Inventors: Xingling Guo, Guangdong (CN); Xiaoping Tan, Guangdong (CN); Man Li, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 172 days.

(21) Appl. No.: 15/327,633

(22) PCT Filed: Jan. 13, 2017

(86) PCT No.: PCT/CN2017/071064
§ 371 (c)(1),
(2) Date: Jan. 19, 2017

(87) PCT Pub. No.: WO2018/120300
PCT Pub. Date: Jul. 5, 2018

(65) Prior Publication Data

US 2018/0218663 A1 Aug. 2, 2018

(30) Foreign Application Priority Data

Dec. 26, 2016 (CN) ..... 2016 1 12176812

(51) Int. Cl.
*G09G 3/20* (2006.01)

(52) U.S. Cl.
CPC ... *G09G 3/2092* (2013.01); *G09G 2300/0426* (2013.01); *G09G 2310/0232* (2013.01);
(Continued)

(58) Field of Classification Search
CPC ... G09G 2300/0426; G09G 2310/0232; G09G 2310/08; G09G 2330/021; G09G 2330/12;
(Continued)

(56) References Cited

U.S. PATENT DOCUMENTS 6,163,866 A * 12/2000 Ansari ..... G01R 31/2808 714/734
2004/0090584 A1* 5/2004 Mai ..... G02F 1/13452 349/149
(Continued)

FOREIGN PATENT DOCUMENTS

CN 202160251 A 3/2012
CN 102662545 A 9/2012
(Continued)

*Primary Examiner* — Richard J Hong
(74) *Attorney, Agent, or Firm* — Andrew C. Cheng

(57) ABSTRACT

The present disclosure relates to a driving system of display panels. The driving system includes a main board and a display panel. The main board is configured with a driving chip, and the driving chip electrically connects to the display panel via a flexible circuit board to drive the display panel to display. With such configuration, the driving system is configured with the main board and the driving chip, and the driving chip is arranged on the main board, instead of the flexible circuit board. With such configuration, the space of the display area occupied by the components is reduced so as to realize the narrow border design for a top border and a bottom border of the display panel. In this way, the screen ratio of the display panel is increased.

13 Claims, 5 Drawing Sheets

(52) U.S. Cl.
CPC ... *G09G 2310/08* (2013.01); *G09G 2330/021* (2013.01); *G09G 2330/12* (2013.01); *G09G 2380/02* (2013.01)

(58) Field of Classification Search
CPC ..... G09G 2380/02; G09G 3/2092; G09G 3/2096; G09G 5/006; G02F 1/13452; H01L 23/15; H01L 51/5246; G06F 1/1626; G01R 27/205; G01R 31/2808; H05K 1/147; G11C 5/04
See application file for complete search history.

(56) References Cited

U.S. PATENT DOCUMENTS

2006/0118950 A1* 6/2006 Amidi ..... G11C 5/04 257/723
2008/0284770 A1* 11/2008 Kwak ..... G02F 1/13452 345/211
2013/0016049 A1 1/2013 Eom et al.
2014/0035935 A1* 2/2014 Shenoy ..... H01L 23/15 345/501
2014/0104252 A1* 4/2014 Park ..... G09G 3/2096 345/205
2014/0246687 A1* 9/2014 Ha ..... G06F 1/1626 257/88
2015/0085144 A1* 3/2015 Li ..... G09G 5/006 348/192
2016/0043344 A1* 2/2016 Shin ..... H01L 51/5246 257/40
2016/0203777 A1* 7/2016 Brahma ..... G01R 27/205 345/211
2017/0048990 A1* 2/2017 Sim ..... H05K 1/147

FOREIGN PATENT DOCUMENTS

CN 203232224 A 10/2013
CN 104009044 A 8/2014
CN 104851892 A 8/2015
CN 204989685 U 1/2016
CN 105932029 A 9/2016
CN 106057109 A 10/2016
CN 106157821 A 11/2016
CN 205788905 A 12/2016
JP 2007192968 A 8/2007

* cited by examiner

DRIVING SYSTEMS OF DISPLAY PANELS

BACKGROUND OF THE INVENTION

1. Field of the Invention

The present disclosure relates to display driving technology, and more particularly to a driving system of display panels.

2. Discussion of the Related Art

With the development of products and technological innovation, consumers have greater demand toward large-screen mobile phones, which makes mobile phone manufacturers continue to increase the proportion of mobile phone screen. Mobile phone manufacturers begin to narrow down the border, or even try to come out with no-border design. However, the above solutions relates to the left or right border, instead of top or bottom border. It can be understood that it is the trend to narrow down the top and the bottom border. To realize such configuration, the most difficult portion is the structure of the display module of the mobile phones.

The display module of mobile phone includes a driver IC and FPCA, wherein the driver IC is a semiconductor component, which is the core of the display panel responsible for processing the image data (Data) transmitted by the central processing unit and for driving the display panel to display the images. FPCA is the bridge between the display panel and the CPU. The Driver IC is loaded on the FPCA, and thus the FPCA usually is configured with a regulation and filter circuit, capacitors, resistors, diodes, power IC, and so on. With respect to the FPCA integrated with the touch panel (TDDI) and display panel, the FPCA is also configured with the storage components supporting the touch panel.

SUMMARY

The present disclosure relates to a driving system of display panels to resolve the above issue, i.e., the display panels of cellular phones cannot be configured with a narrow border design, especially for the top and down borders.

In one aspect, a driving system of display panels includes: a main board and a display panel, the main board being configured with a driving chip, the display panel comprising a display area and a non-display area configured below the display area, the non-display area comprising a lead unit, a splitter unit, a testing unit, and a fan-out unit arranged in sequence; wherein sub-pixels in the display area electrically connect to the lead unit, the lead unit electrically connects to the splitter unit, the splitter unit and the testing unit electrically connect to the fan-out unit respectively, and the fan-out unit electrically connects to the driving chip, and the driving chip electrically connects to the display panel via a flexible circuit board to drive the display panel to display, and the flexible circuit board is a double-sided flexible circuit board.

In another aspect, a driving system of display panels includes: a main board and a display panel, the main board being configured with a driving chip, and the driving chip electrically connecting to the display panel via a flexible circuit board to drive the display panel to display.

Wherein the display panel includes a display area and a non-display area configured below the display area, the non-display area includes a lead unit, a splitter unit, a testing unit, and a fan-out unit arranged in sequence; wherein sub-pixels in the display area electrically connect to the lead unit, the lead unit electrically connects to the splitter unit, the splitter unit and the testing unit electrically connect to the fan-out unit respectively, and the fan-out unit electrically connects to the driving chip.

Wherein the flexible circuit board includes a main body, a first connecting area, and a second connecting area; wherein the fan-out unit electrically connects to the first connecting area via a bonding method, and the driving chip electrically connects to the second connecting area via the bonding method or a connector.

Wherein the connector is a top-pin connector.

Wherein material of the bonding method is an anisotropic conductive film.

Wherein the main board is further configured with a power regulation circuit electrically connecting to the driving chip, the power regulation circuit provides regulated power to the driving chip.

Wherein the main board is configured with a filter circuit electrically connecting to the power regulation circuit, and the filter circuit provides a filtering function to the power regulation circuit.

Wherein the flexible circuit board is a double-sided flexible circuit board.

Wherein the main board on the driving system further includes a main chip electrically connecting to a driving chip, the main chip is configured to receive and parse video signals to obtain driving signals and timing signals, the driving chip receives the driving signals and the timing signals, and drives the display panel to display in accordance with the driving signals and the timing signals.

In another aspect, a driving system of display panels includes: a main board and a display panel, the main board is configured with a main chip, and the main chip electrically connects to the display panel via a flexible circuit board to drive the display panel to display.

Wherein the display panel includes a display area and a non-display area configured below the display area, the non-display area includes a lead unit, a splitter unit, a testing unit, and a fan-out unit arranged in sequence; wherein sub-pixels in the display area electrically connect to the lead unit, the lead unit electrically connects to the splitter unit, the splitter unit and the testing unit electrically connect to the fan-out unit respectively, and the fan-out unit electrically connects to the main chip.

Wherein the flexible circuit board includes a main body, a first connecting area, and a second connecting area; wherein the fan-out unit electrically connects to the first connecting area via a bonding method, and the main chip electrically connects to the second connecting area via the bonding method or a connector.

Wherein the connector is a top-pin connector.

Wherein material of the bonding method is an anisotropic conductive film.

Wherein the main board is further configured with a power regulation circuit electrically connecting to the driving chip, the power regulation circuit provides regulated power to the driving chip.

Wherein the main board is configured with a filter circuit electrically connecting to the power regulation circuit, and the filter circuit provides a filtering function to the power regulation circuit.

Wherein the flexible circuit board is a double-sided flexible circuit board.

In view of the above, the driving system is configured with the main board and the driving chip, and the driving chip is arranged on the main board 40, instead of the flexible circuit board. With such configuration, the space of the display area occupied by the components is reduced so as to realize the narrow border design for a top border and a bottom border of the display panel. In this way, the screen ratio of the display panel is increased.

BRIEF DESCRIPTION OF THE DRAWINGS

Embodiments of the invention will now be described more fully hereinafter with reference to the accompanying drawings, in which embodiments of the invention are shown. Apparently, the accompanying drawings are only some embodiments of the claimed invention. Those of ordinary skill can derive other drawings from these drawings without creative efforts.

DETAILED DESCRIPTION OF THE EMBODIMENTS

Embodiments of the invention will now be described more fully hereinafter with reference to the accompanying drawings, in which embodiments of the invention are shown.

Figure 1:
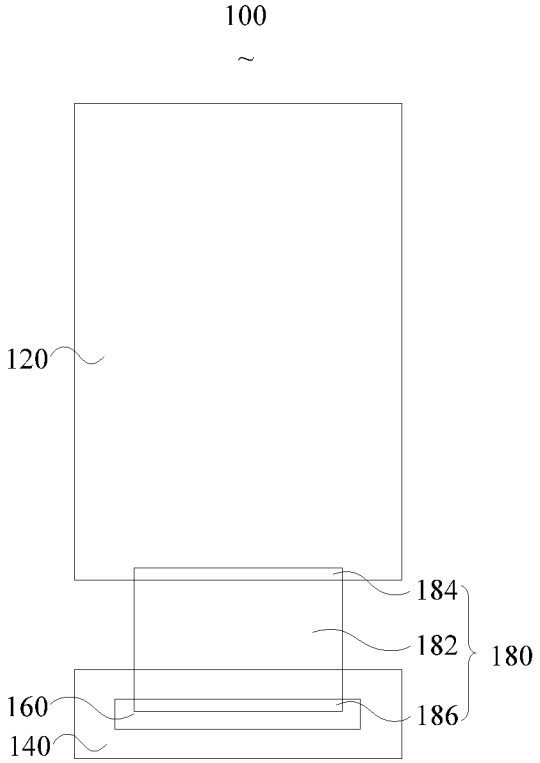
FIG. 1 is as schematic view of the driving system of display panels in accordance with a first embodiment.
Figure 2:
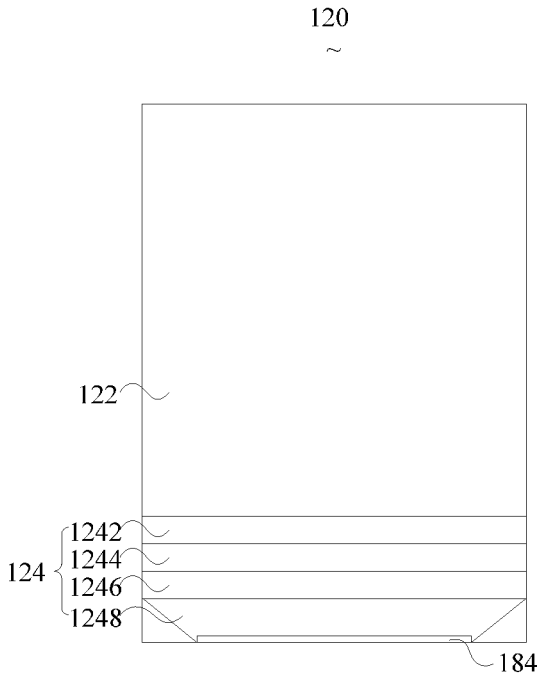
FIG. 2 is a schematic view of the display panel in accordance with the first embodiment.

FIG. 1 is as schematic view of the driving system of display panels in accordance with a first embodiment. FIG. 2 is a schematic view of the display panel in accordance with the first embodiment.

As shown in FIG. 1, the driving system 100 of display panels includes a display panel 120 and a main board 140, wherein the main board 140 is configured with a driving chip 160 electrically connecting to the display panel 120 via a flexible circuit board 180 so as to drive the display panel 120 to display.

The driving system 100 is configured with the main board 140 and the driving chip 160, and the driving chip 160 is arranged on the main board 140, instead of the flexible circuit board 180. With such configuration, the space of the display area occupied by the components is reduced so as to realize the narrow border design for a top border and a bottom border of the display panel 120. In this way, the screen ratio of the display panel 120 is increased.

Referring to FIG. 2, the display panel 120 includes a display area 122 and a non-display area 124, wherein the non-display area 124 is arranged below the display area 122, the non-display area 124 includes a lead unit 1242, a splitter unit 1244, a testing unit 1246, and a fan-out unit 1248.

Wherein sub-pixels in the display area 122 electrically connect to the lead unit 1242, the lead unit 1242 electrically connects to the splitter unit 1244, the splitter unit 1244 and the testing unit 1246 electrically connect to the fan-out unit 1248, and the fan-out unit 1248 electrically connects to the driving chip 160.

Specifically, the lead unit 1242 includes signal lines connected with the sub-pixels in the display area 122. In one embodiment, the lead unit 1242 also includes virtual sub-pixels, which are not configured to display. The signal lines includes scanning lines, data lines, or a combination of scanning lines and data lines. The number of the signal lines may be greatly reduced by the splitter unit 1244, and the lead unit 1242 is transformed into the splitter unit 1244. Afterward, the splitter unit 1244 and the testing unit 1246 respectively electrically connects to the fan-out unit 1248. The fan-out unit 1248 is a conventional design of printed circuit boards (PCBs), especially for the circuit of high density and of a great number of pins. That is, a second of the pins of one component is lead out, and a through hole is formed. In the end, the fan-out unit 1248 electrically connects to the driving chip 160.

The display panel 120 decreases the number of the driving chip 160 and the components electrically connected to the driving chip 160 such that the width of the bottom border of the display panel 120 may be narrower. As the driving chip 160 is omitted, the scanning lines have not to be configured within the driving chip 160, and thus the bending angle of the trace within the fan-out unit 1248 can be smaller, that is, the width may be narrower, and the width of the bottom border of the display panel 120 may be narrower. With such configuration, the bottom border of the display panel 120 can be reduced up to 50%, which enhances the screen ratio.

Specifically, the flexible circuit board 180 includes a main body 182, a first connecting area 184, and a second connecting area 186, wherein the fan-out unit 1248 electrically connects to the first connecting area 184 via a bonding method, and the driving chip 160 electrically connects to the second connecting area 186 via the bonding method or a connector. Specifically, the connector is a top-pin connector, especially the top-pin connector having enough pins. The bonding material is an anisotropic conductive film formed by connecting the electrodes between flexible circuit board 180 and the main board 140 or between the flexible circuit board 180 and the driving chip 160 by the conductive particle. The anisotropic conductive film (ACF) has the characteristics of being capable of continuous processing and extremely low material loss making it the most commonly used product form.

The flexible circuit board 180 is a double-sided flexible circuit board, specifically, the first connecting area 184 is lead out, and half of the signal lines are respectively lead to two layers via through holes, which reduces the dimension of the flexible circuit board and the cost.

In view of the above, the FPCA may be replaced by flexible circuit board 180 connecting the display panel 120 and the main board 140. The driving chip 160 is integrated on the main board 140. The density of the main board 140 is increased so as to enhance the stability of the circuit.

Figure 3:
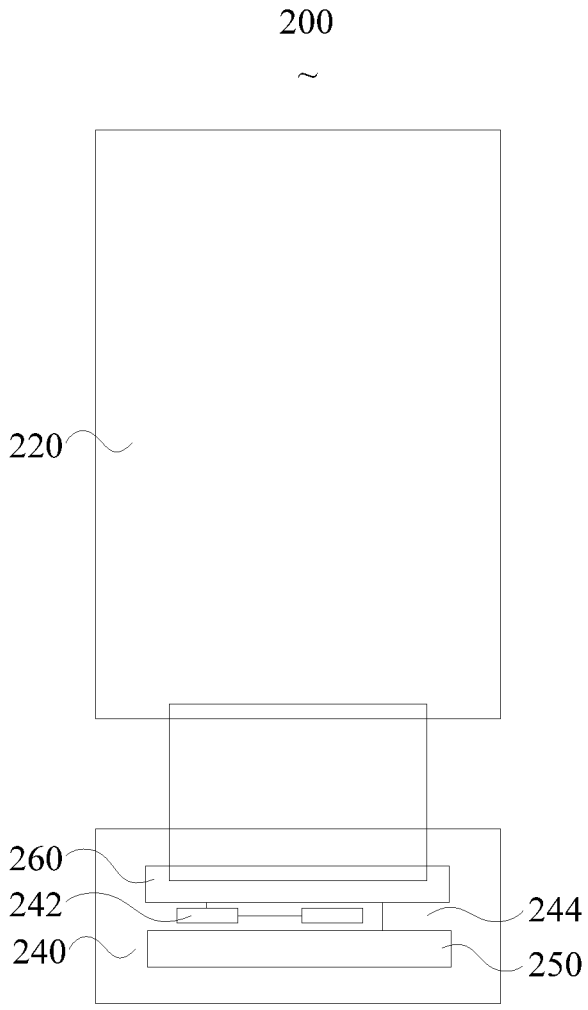
FIG. 3 is a schematic view of the driving system of display panels in accordance with a second embodiment.

FIG. 3 is a schematic view of the driving system of display panels in accordance with a second embodiment.

As shown in FIG. 3, the main board 240 on the driving system 200 further includes a main chip 250 electrically connecting to a driving chip 260. The main chip 250 is configured to receive and parse video signals to obtain driving signals and timing signals. The driving chip 260 receives the driving signals and the timing signals, and drives the display panel 220 to display in accordance with the driving signals and the timing signals, and the main chip 250 communicates with the driving chip 260 via P2P or I2C wirings.

In the embodiment, the main board 240 is further configured with a power regulation circuit 242 electrically connecting to the driving chip 260, the power regulation circuit 242 provides regulated power to the driving chip 260, the main board 240 is configured with a filter circuit 244, the filter circuit 244 electrically connects to the power regulation circuit 242, and the filter circuit 244 provides the filtering function to the power regulation circuit 242, wherein the power regulation circuit 242 and the filter circuit 244 are made by capacitors, resistors, inductors and diodes and other components. In other embodiment, the power regulation circuit 242 and the filter circuit 244 may be integrally configured to be one circuit.

Figure 4:
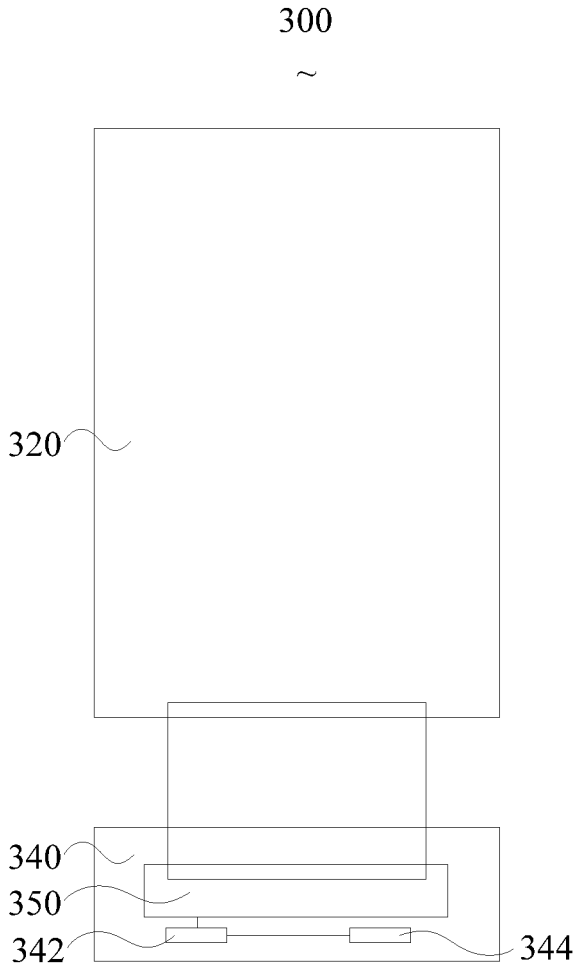
FIG. 4 is a schematic view of the driving system of display panels in accordance with a third embodiment.

FIG. 4 is a schematic view of the driving system of display panels in accordance with a third embodiment.

As shown in FIG. 4, the driving system 300 includes a display panel 320 and a main board 340, wherein the main board 340 is configured with a main chip 350 electrically connecting to the main board 340 via the flexible circuit board 380, and drives the display panel 320 to display. The main board 340 is configured with a regulation circuit 342 electrically connecting to the main chip 350. The regulation circuit 342 provides regulated power to the main chip 350. The main board 340 further includes a filter circuit 344 electrically connecting to the regulation circuit 342, and the filter circuit 344 provides the filtering function to the regulation circuit 342.

The structure in the third embodiment is basically the same with that in the second embodiment. The main chip 350 integrates the functions of the main chip 250 and the driving chip 260 to provide a more integral driving system 300. Not only the density of the circuit is enhanced, but also the stability of the circuit is also enhanced.

Wherein the functions and the structure of the main chip and the driving chip may be referenced to the above.

Figure 5:
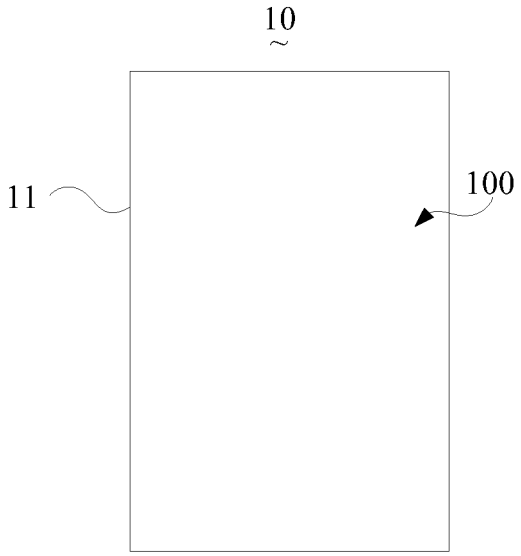
FIG. 5 is a schematic view of the mobile terminal in accordance with one embodiment.

FIG. 5 is a schematic view of the mobile terminal in accordance with one embodiment.

As shown in FIG. 5, the mobile terminal 10 includes a main body 11 and the above driving system 100 of the display panel.

The structure of the driving system 100 may be referenced in the above.

In view of the above, the driving system is configured with the main board and the driving chip, and the driving chip is arranged on the main board 40, instead of the flexible circuit board. With such configuration, the space of the display area occupied by the components is reduced so as to realize the narrow border design for a top border and a bottom border of the display panel. In this way, the screen ratio of the display panel is increased.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A driving system of display panels, comprising:

a main board and a display panel, the main board being configured with a driving chip, the display panel comprising a display area and a non-display area configured below the display area, the non-display area comprising a lead unit, a splitter unit, a testing unit, and a fan-out unit arranged in sequence;

wherein sub-pixels in the display area electrically connect to the lead unit, the lead unit electrically connects to the splitter unit, the splitter unit and the testing unit electrically connect to the fan-out unit respectively, and the fan-out unit electrically connects to the driving chip, and the driving chip electrically connects to the display panel via a flexible circuit board to drive the display panel to display, and the flexible circuit board is a double-sided flexible circuit board.

2. The driving system as claimed in claim 1, wherein the lead unit comprises signal lines connected with the sub-pixels in the display area; the signal lines comprises scanning lines, data lines, or a combination of scanning lines and data lines; and the lead unit is transformed into the splitter unit, and the number of the signal lines are reduced by the splitter unit.

3. The driving system as claimed in claim 2, wherein the lead unit further comprises virtual sub-pixels which are not configured to display.

4. A driving system of display panels, comprising:

a main board and a display panel, the main board being configured with a driving chip, and the driving chip electrically connecting to the display panel via a flexible circuit board to drive the display panel to display;

wherein the display panel comprises a display area and a non-display area configured below the display area, the non-display area comprises a lead unit, a splitter unit, a testing unit, and a fan-out unit arranged in sequence;

wherein sub-pixels in the display area electrically connect to the lead unit, the lead unit electrically connects to the splitter unit, the splitter unit and the testing unit electrically connect to the fan-out unit respectively, and the fan-out unit electrically connects to the driving chip.

5. The driving system as claimed in claim 4, wherein the flexible circuit board comprises a main body, a first connecting area, and a second connecting area;

wherein the fan-out unit electrically connects to the first connecting area via a bonding method, and the driving chip electrically connects to the second connecting area via the bonding method or a connector.

6. The driving system as claimed in claim 5, wherein the connector is a top-pin connector.

7. The driving system as claimed in claim 5, wherein material of the bonding method is an anisotropic conductive film.

8. The driving system as claimed in claim 4, wherein the main board is further configured with a power regulation circuit electrically connecting to the driving chip, the power regulation circuit provides regulated power to the driving chip.

9. The driving system as claimed in claim 8, wherein the main board is configured with a filter circuit electrically connecting to the power regulation circuit, and the filter circuit provides a filtering function to the power regulation circuit.

10. The driving system as claimed in claim 4, wherein the flexible circuit board is a double-sided flexible circuit board.

11. The driving system as claimed in claim 4, wherein the main board on the driving system further comprises a main chip electrically connecting to a driving chip, the main chip is configured to receive and parse video signals to obtain driving signals and timing signals, the driving chip receives the driving signals and the timing signals, and drives the display panel to display in accordance with the driving signals and the timing signals.

12. The driving system as claimed in claim 4, wherein the lead unit comprises signal lines connected with the sub-pixels in the display area; the signal lines comprises scanning lines, data lines, or a combination of scanning lines and data lines; and the lead unit is transformed into the splitter unit, and the number of the signal lines are reduced by the splitter unit.

13. The driving system as claimed in claim 12, wherein the lead unit further comprises virtual sub-pixels which are not configured to display.

* * * * *